United States Patent [19]

Boucher

[11] 4,152,708

[45] May 1, 1979

[54] COLLAPSIBLE TWO ELEMENT CUBICAL QUAD RADIO ANTENNA

[76] Inventor: Norris G. Boucher, 913 Chestnut Ave., Dubois, Pa. 15801

[21] Appl. No.: 827,866

[22] Filed: Aug. 26, 1977

[51] Int. Cl.[2] ..... H01Q 11/12; H01Q 7/00; H01Q 1/08

[52] U.S. Cl. ..... 343/880; 343/868; 343/741

[58] Field of Search..... 343/741, 742, 868, 880, 881, 343/882

[56] References Cited

U.S. PATENT DOCUMENTS

| | | | |
|---|---|---|---|
| 1,779,437 | 10/1930 | Loughridge | 343/881 |
| 3,562,755 | 2/1971 | Bonadio | 343/814 |

FOREIGN PATENT DOCUMENTS

| | | | |
|---|---|---|---|
| 574671 | 10/1923 | France | 343/882 |

*Primary Examiner*—Alfred E. Smith
*Assistant Examiner*—Harry E. Barlow
*Attorney, Agent, or Firm*—Thomas E. Sterling

[57] ABSTRACT

This invention is a collapsible two element cubical quad antenna consisting of two separate four member antenna elements. One end portion of each antenna element converges at a vertex and the other end portion of the antenna element describes a square. The axis of the vertex of one antenna element is positioned opposite to the axis of the vertex of the other antenna element. Thus, the end portions of both antenna elements, as positioned, describe a cubical figure. The end portion of both antenna elements serve as support points for antenna wires.

8 Claims, 6 Drawing Figures

COLLAPSIBLE TWO ELEMENT CUBICAL QUAD RADIO ANTENNA

This invention is a collapsible support for radio antennas, that does not require the removal of the antenna elements to collapse; and, in fact, relies upon the antenna elements for its dimensional stability when erect. It is, therefore, an integrated design of support and antenna elements (of various suitable types), which can be collapsed for ease of transportation, installation, or removal.

The support structure of this invention will always be constructed of basic elements, or an equivalent analog thereof. Although a basic element as shown consists of two (2) spreader arms and one common pivot point, not at either end, the addition of one or more spreader arms to the common pivot point, or to a pivot point anywhere along either of the two spreader arms does not alter the basic concept. As by insinuation, each pair so connected to a common pivot point forms one basic element, whose mechanical analog is exactly one basic element intimately a part of a second basic element, etc.

These basic elements, when integrated with an antenna of a suitable type, will reduce that antenna dimensionally in the plane of the antenna elements for the purpose of collapsibility, yet be dimensionally stable when erect and attached to a mast (or mechanical analog thereof), which holds the support structure and antenna elements in tension.

Furthermore, the collapsible support mechanism and the antenna elements are only thus separately defined as to make the mechanism conceivable, and not to limit the use of the basic elements of the support structure, in part or whole, in the formation of an active or passive element of an appropriate antenna type (i.e. the basic elements may form in whole or part a necessary component of a functional antenna type in either the electrical or mechanical sense, as well as lend it obvious supportive properties).

However, the basic concept only extends to the mechanizations comprised of basic elements insofar as it is part of an antenna or system of antennas, but totally thereto whether by concept the completed or unfinished antenna type and supportive mechanism consisting of basic elements is meant to be collapsible, or not, as long as basic elements, or equivalent mechanical analog traceable to basic elements is used in conjunction with an antenna type, in part or in whole.

This invention relates to radio antennas in particular to a collapsible support for radio antannas.

An object of this invention is to provide a completely assembled, but collapsed radio antenna, which can be easily and quickly erected where desired.

Another object of this collapsible support structure is to make an assembled radio antenna system dimensionally smaller for ease of transportation and installation.

Another object of this invention is to provide the user with a completely assembled radio antenna that requires little electrical or mechanical knowledge to properly install.

Another object of this invention is to reduce the number of persons required to install normal, physically large antenna, by virtue of the collapsible radio antennas smaller dimensions.

Another object of this invention is to provide a simply built radio antenna support structure for many types of suitaable radio antenna types.

Another object of this invention is to provide a radio antenna support structure which could also function as an integral part of a radio antenna, or a system of radio antennas.

These and other objects of the invention will become more apparent upon reference to the following description and accompanying drawings.

Figure 1:
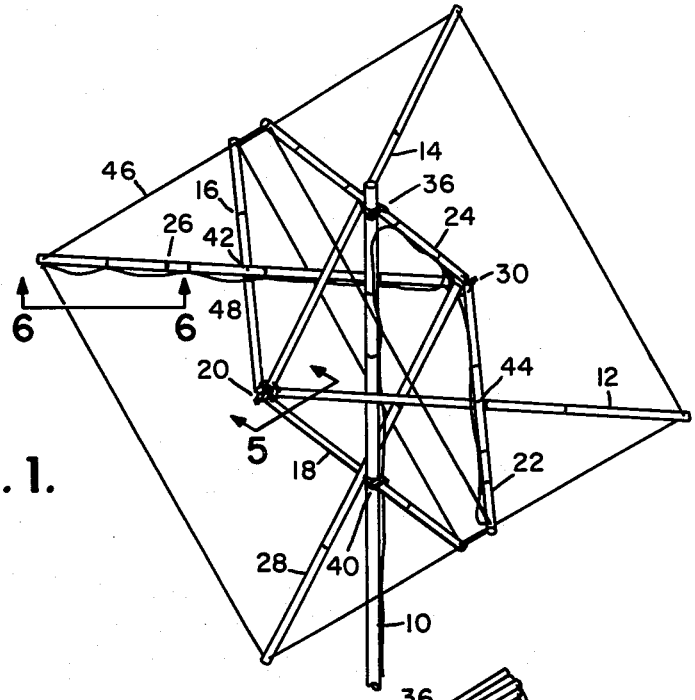
FIG. 1 is a perspective view of the assembled antenna embodying the plans of this invention.

Referring to the drawings, and in particular to FIG. 1, 10 generally represents a mast used to support the structure of this invention. Spreader arms 12, 14, 16, and 18 converge at a vertex 20 positioned on one side of the mast 10. Spreader arms 22, 24, 26 and 28 converge the vertex 30, positioned diametrically opposite vertex 20 on the other side of mast 10. These spreader arms face and extend through spreader arms 12, 14, 16 and 18 extending from vertex 20. The tips of the spreader arms 12, 14, 16, 18, 22, 24, 26 and 28 are so positioned in space as to form the vertices of a cube.

Figure 5:
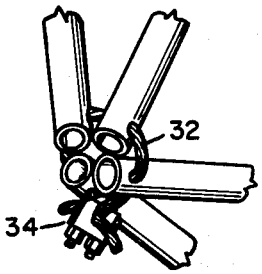
FIG. 5 is a perspective view taken along lines 5—5 of FIG. 1.

Referring now to FIG. 5, vertex 20 is comprised of a cable 32 which passes through the end portions of spreader arms 12, 14, 16 and 18. The end portions of cable 32 are attached together by a cable clamp 34. Thus the spreader arms 12, 14, 16 and 18 may be freely rotated relative to one another. Vertex 30 is constructed similarly to vertex 20, having a cable (not shown) passing through the end portion of spreader arms 22, 24, 26 and 28. The cable (not shown) is secured by a cable clamp (not shown) in a manner similar to that described for vertex 20.

Figure 4:
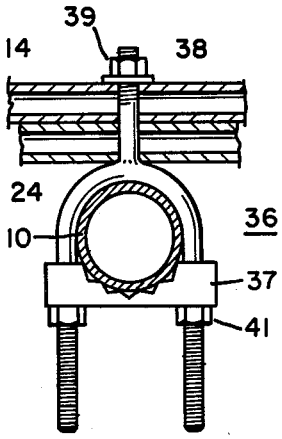
FIG. 4 is a plan view taken along lines 4—4 of FIG. 2.

Referring now to FIG. 4, spreader arms 14 and 24 are pivotally secured to mast 10 by U-bolt 36 having a bolt member 38 extending therefrom. Bolt member 38 passes through spreader arms 14 and 24 allowing the spreader arms to pivot about bolt member 38. A nut 39 screwably attached to bolt member 38 secures spreader arms 14 and 24 so that they may rotate about bolt member 38. In a similar fashion, spreader arms 18 and 28 are attached to U-bolt assembly 40, which is secured to mast 10, allowing spreader arms 18 and 28 to pivot about a bolt member (not shown) attached to U-bolt assembly 40. U-bolt assemblies 36 and 40 are thus pivot points for the spreader arms of the invention. U-bolt assembly 36 extends around mast 10. A retaining member 37, through which the end portions of U-bolt assembly 36 passes, clamps against mast 10. Retaining bolts 41 screwably attached to the end portion of U-bolt assembly 36 press retaining member 36 against mast 10, clamping U-bolt assembly 36 against mast 10. U-bolt assembly 40 is identical to U-bolt assembly 36, and allows spreader arms 18 and 28 to pivot thereon.

Spreader arms 16 and 26 are pivotally attached to one another at about their mid point by a pivot bolt 42 extending through spreader arms 16 and 26 and secured by a pivot nut (not shown). Similarly, spreader arms 12 and 22 are pivotally attached to one another by a pivot bolt 44 extending through the spreader arms 12 and 22, secured by a pivot nut (not shown).

Figure 6:
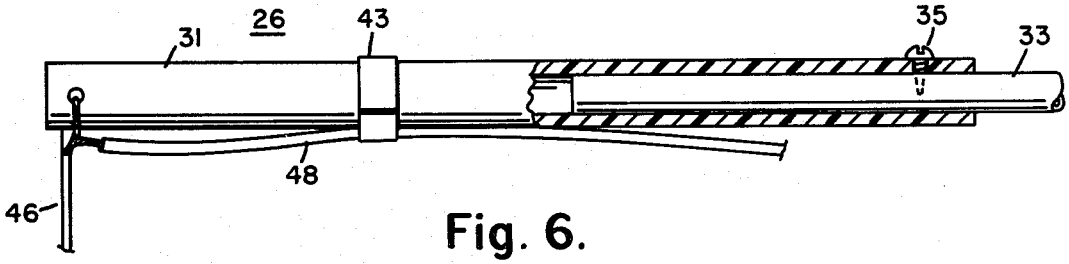
FIG. 6 is a plan view, partially in section taken along lines 6—6 of FIG. 1.

Referring now to FIG. 6, tip portion of spreader arm 26 is comprised of a plastic conduit or pipe 31. The portion of the spreader arm 26 extending from vertex 30 is comprised of metallic tubing 33 which extends into plastic pipe 31 and is retained there by a retaining screw 35 which screwably extends through plastic tubing 31 and metal tubing 33. The tip portions on the spreader arms 12, 14, 16, 18, 22, 24 26 and 28 to which antenna wires 46 and 50 are attached are comprised of plastic pipe similar to that previously described relating to spreader arm 26. This plastic pipe acts as an electrical insulator. The balance of the spreader arms are comprised of metal tubing similar to that of plastic pipe 31.

Referring now to FIG. 1, antenna wire 46, that forms the driven element, is threaded through the insulated tip portions of spreader arms 26, 28, 22, 24, and 26 again. At spreader arms 26 two holes are provided for the antenna wire, so that the ends of the driven element antenna wire are attached to spreader arm 26 without touching. With the antenna wire distributed equally between the spreader arms, keepers are attached to the antenna wire at spreader arms 28, 22 and 24. The keepers are formed by passing short pieces of antenna wire around a spreader arm, twisting the ends of these pieces about the driven element antenna wire, and soldering. The antenna lead-in cable 48 is attached to the open ends of the driven element antenna at the spreader arm 26 and is dressed along and taped to spreader arm 26 by tape 43. Antenna lead-in cable 48 extends down mast 10 and is ultimately attached to the appropriate radio set (not shown).

In similar fashion antenna wire 50 passes through the end portions of the spreader arms in a closed loop fashion, the two ends of the antenna wire being twisted together and soldered at spreader arm 16. Wire keepers are also installed on antenna wire 50. It should be noted that when the antenna is in its extended position, antenna wires 46 and 50 are under tension acting as support members for the spreader arms to which they are connected.

In operation the assembled collapsed antenna is brought to mast 10 and U-bolt assemblies 36 and 40 attached thereto. The U-bolt assemblies 36 and 40 are then spread apart from one another, causing the structure to erect in its final form. When the structure has been completely erected U-bolt assemblies 36 and 40 are tied upon mast 10 securing the entire structure in a rigid condition.

Figure 2:
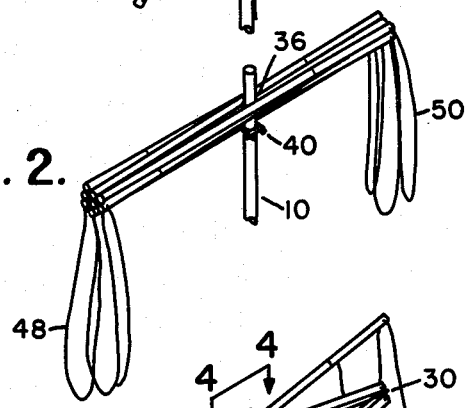
FIG. 2 is a perspective view of the invention in its collapsible state.
Figure 3:
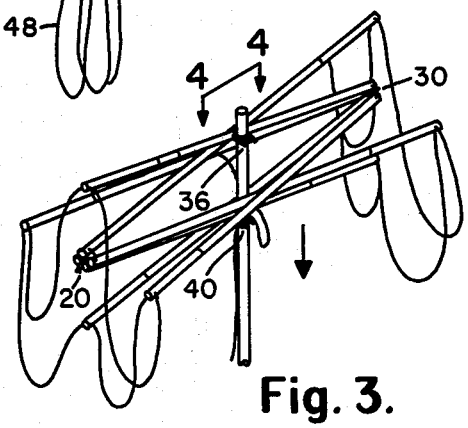
FIG. 3 is a perspective view of the invention while it is in the process of being erected.

In its collapse form, the invention resembles a bundle of compact rods (see FIG. 2). Upon spreading of U-bolt assemblies 36 and 40 the structure begins to rise (see FIG. 3). At the points the spreader arms are separating at vertex 20 and 30, spreader arms 18 and 28 are rotaing about U-bolt assembly 40 and spreader arms 14 and 24 rotating about U-bolt assembly 36. Spreader arms 16 and 26 rotate about pivot bolt 42 and spreader arms 12 and 22 rotate about pivot bolt 44. When fully assembled, wires 48 and 50 are under tension and the eight tips of the spreader arms describe the eight vertices of a cubical figure. The structure may be easily collapsed by reversing the above steps.

It is understood that the above description of this invention is by way of example only and that various modifications may be made thereof without departing from the spirit of the invention as below claimed.

1. A collapsible antenna array comprising, in combination:

a support member;

a pair of first support spreader arms and a pair of first rotatable spreader arms converging at a first vertex, said pair of first rotatable spreader arms rotatably attached to said support member by support means;

a pair of second support spreader arms and a pair of second rotatable spreader arms converging at a second vertex, said pair of second rotatable spreader arms rotatably attached to said support member by support means;

pivot means for rotatably attaching said first support spreader arms to said second support spreader arms;

vertex attaching means coupling said first vertex and coupling said second vertex;

antenna attaching means coupling an antenna to the end portion of said first support spreader arms, said first rotatable spreader arms, said second support spereader arms, and said second rotatable spreader arms to form a cubical array;

antenna lead wires attached to said antenna.

2. The combination as claimed in claim 1, in which said vertex attaching means is comprised of, in combinaton:

cable means extending through the end portons of said first support spreader arms, first rotatable spreader arms, second support spreader arms, and second rotatable spreader arms;

wire clamp means securing said cable means.

3. The combination as claimed in claim 2, in which said support means is comprised of, in combination:

a U-bolt extending about said support member;

a bolt member attached to said U-bolt and extending therefrom, said bolt member extending through said first rotatable spreader arms and said second rotatable spreader arms;

a nut member screwably attached to said bolt member;

a clamp member attached to said U-bolt securing said support member to said U-bolt;

clamp nuts screwably attached to said U-bolt securing said clamp member to support member.

4. The combination as claimed in claim 3, in which the end portion of said first support spreader arms, said first rotatable spreader arms, said second support spreader arms, and said second rotatable spreader arms is comprised of an electrical insulating material.

5. The combination as claimed in claim 4, in which said pivot means is comprised of, in combination:

a bolt extending throughout first support spreader arm and said second support spreader arm;

a nut screwably attached to said bolt.

6. A collapsible antenna array, comprising in combination:

a support member;

four first spreader arms converging at a first vertex, two of said first spreader arms being slidably attached to said support member;

four second spreader arms converging at a second vertex, two of said second spreader arms being slidably attached to said support member, the axis of said second vertex being substantially in a direction opposite to the axis of said first vertex;

pivot means coupling a first spreader arms to a second spreader arm;

antenna attachment means connected to the end portion of said four first spreader arms and to the end portion of said four second spreader arms.

7. The combination as claimed in claim 6 in which said first vertex is rotatably connected by a cable and in which said second vertex is rotatably connected by a cable.

8. The combination as claimed in claim 7, in which said slidable attachment of said spreader arms is comprised of, in combination:

a U-bolt extending about said support member and secured thereto;

a bolt member attached to said U-bolt extending through said first rotatable spreader arm and said second rotatable spreader arm;

a nut screwably attached to said bolt.

* * * * *